United States Patent [19]

Alonso

[11] 4,242,546

[45] Dec. 30, 1980

[54] ELECTRICAL PUSH-BUTTON SWITCH

[75] Inventor: Oscar Alonso, Westminster, Calif.

[73] Assignee: International Telephone and Telegraph Corporation, New York, N.Y.

[21] Appl. No.: 957,892

[22] Filed: Nov. 6, 1978

[51] Int. Cl.[3] ..... H01H 1/12; H01H 13/52; H01H 15/00

[52] U.S. Cl. ..... 200/16 A; 200/159 R; 200/264

[58] Field of Search ..... 200/5 A, 159 B, 264, 200/16 A, 159 R

[56] References Cited

U.S. PATENT DOCUMENTS

| | | | |
|---|---|---|---|
| 3,696,408 | 10/1972 | Bouchard et al. | 200/264 X |
| 3,699,294 | 10/1972 | Sudduth | 200/264 |
| 3,950,627 | 4/1976 | Murata et al. | 200/264 X |
| 3,952,173 | 4/1976 | Tsuji et al. | 200/264 |
| 4,132,873 | 1/1979 | Vanderpoel | 200/264 X |

FOREIGN PATENT DOCUMENTS

| | | |
|---|---|---|
| 1259567 | 1/1972 | United Kingdom . |
| 1312740 | 4/1973 | United Kingdom . |
| 1396467 | 6/1975 | United Kingdom . |
| 1491826 | 11/1977 | United Kingdom . |
| 1552639 | 9/1979 | United Kingdom . |

*Primary Examiner*—James R. Scott
*Attorney, Agent, or Firm*—Thomas L. Peterson

[57] ABSTRACT

A push-button switch in which a resilient conductive elastomer bridging contact member is compressed directly against two or more printed conductors between which it is desired to selectively make and break electrical continuity. The conductive elastomer member is used as a beam having a central portion in contact with the printed circuit board for mechanical support. The member is formed so that it diverges from the plane of the conductors on the circuit board outwardly from the central mechanical support portion, mechanical compression as by a push-button arrangement elastically deforming the member into contact with the printed circuit conductors. Release of this compressive force permits the member to resume its initial shape correspondingly breaking the electrical continuity.

8 Claims, 4 Drawing Figures

ELECTRICAL PUSH-BUTTON SWITCH

BACKGROUND OF THE INVENTION

1. Field of the Invention

The invention relates to electric switches generally and more particularly to push-button switches employing conductive elastomer switch elements.

2. Description of the Prior Art

In the prior art conductive elastomer materials are known per se. Many of these materials involve the use of a resilient retainer material such as silicon rubber, for example, having therein particles of a finely dispersed conductive metal. One such material is silver flake, a concentration of as low as a few percent by volume operating produce conduction through a dimension of the silicon rubber body or container in response to applied compression.

U.S. Pat. No. 3,680,037 describes the use of a conductive elastomer material embedded in a dielectric sheet at various selected locations. Such conductive elastomer plugs overlap or protrude from the two opposite faces of the dielectric sheet so that they're subjected to compression when sandwiched between two circuit boards (for example) which it is desired to interconnect at selected points.

U.S. Pat. No. 4,065,197 describes a sheet connector based on the conductive elastomer technique. That device involves the application of discrete pressure points from the circuit boards or other devices to be interconnected. The areas between the discrete pressure points substantially nonconducting so that there is very satisfactory isolation among the plural pressure points providing conduction through the thickness of the sheet. The aforementioned U.S. Pat. No. 4,065,197 describes material composition and process steps in considerable detail and in a number of alternative material compositions.

Still further, conductive elastomer materials used in one manner or another as electrical connectors are described in U.S. Pat. Nos. 3,648,002, 4,068,032 and 4,050,756 and in pending patent application O. Alonso-3, filed June 5, 1978, Ser. No. 912,381 now abandoned, this application being assigned to the Assignee of present application.

Notwithstanding the substantial art in the patent literature and otherwise in respect to conductive elastomers, their application and a combination producing a push-button switch according to the present invention, is not evident in the prior art.

Push-button switches per se have been produced in many forms, most commonly with metal-to-metal contact arrangements and spring resilience. Such switches are, on the whole, poorly adapted to direct placement on electronic circuit boards, and their overall reliability and cost are unfavorable.

The manner in which the present invention employs the known conductive elastomer materials in a unique combination dealing with the prior disadvantages will be understood as this description proceeds.

SUMMARY

According to the invention, a conductive elastomer member is arranged to be subjected to pressure from the push-button of a switch, causing it to deflect and make contact with at least two conductive strips or traces (as for example on a printed circuit board) between which it is desired to selectively effect electrical continuity in response to the pressure of said push-button.

In its preferred form, the elastomer member operates as a bridging contact member having a central surface resting normally on the circuit board surface between the selected conductors or traces and diverging upward away from the plane of the circuit board. The compression applied through the push-button forces these divergent portions of the elastomer member on either side of the central support portion to be depressed and compressed against the traces. Release of the pressure permits the electrical continuity to be broken as the elastomer member returns to its initial or rest (nonstressed) shape.

If the compression force aforementioned is defined as being axially applied to the elastomer bridge member, then grooves or slots formed into the bridging member extending axially from the surface of the elastomer member facing the circuit board may be described as axially extending. These grooves facilitate the deflection of the elastomer member when compressed.

The details of a typical and preferred embodiment will be hereinafter described and will be understood by those skilled in this art as the description proceeds.

DESCRIPTION OF THE PREFERRED EMBODIMENT

Figure 1:
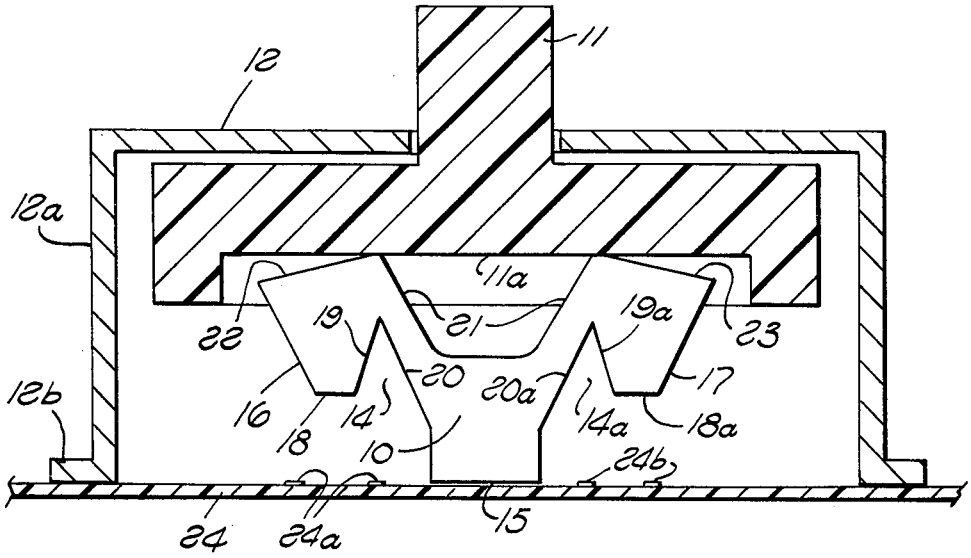
FIG. 1 is a section taken axially through a switch assembly according to the invention mounted on the circuit board, with conductive elastomer bridging element in its undeflected position.

Referring now to FIG. 1, a typical assembly of the pushbutton switch according to the invention, as mounted on a circuit board 24, is illustrated. Basically, the switch assembly comprises the push-button 11 having a surface 11*a* bearing against the upper portion of the resilient conductive elastomer bridging member 10. An enclosure 12 having sides 12*a* and a foot portion 12*b* to facilitate its mounting on circuit board 24 depicts one form of mechanical housing and guidance means for the push-button 11. In the type of application to which the invention is applicable, there can be significant variation in these purely mechanical ancillary structures. For example, the upper part of the enclosure or housing 12 might be a parallel circuit board or other planar member independently supported in the indicated position, in which case the sides 12*a* and foot portions 12*b* would be absent.

In FIG. 1 it is assumed that, in the switch closure it is desired to electrically connect together the printed circuit tracks 24*a* and to bridge these with the corresponding print circuit tracks at 24*b*.

The resilient conductive elastomer member 10 includes a base surface 15 resting against the circuit board 24, or even being cemented thereo in the position shown. The grooves 14 and 14*a* serve to facilitate the downward deflection of the two "wings" of the conductive elastomer bridging member 10 in response to downward compressive force applied to the push-button 11.

Figure 2:
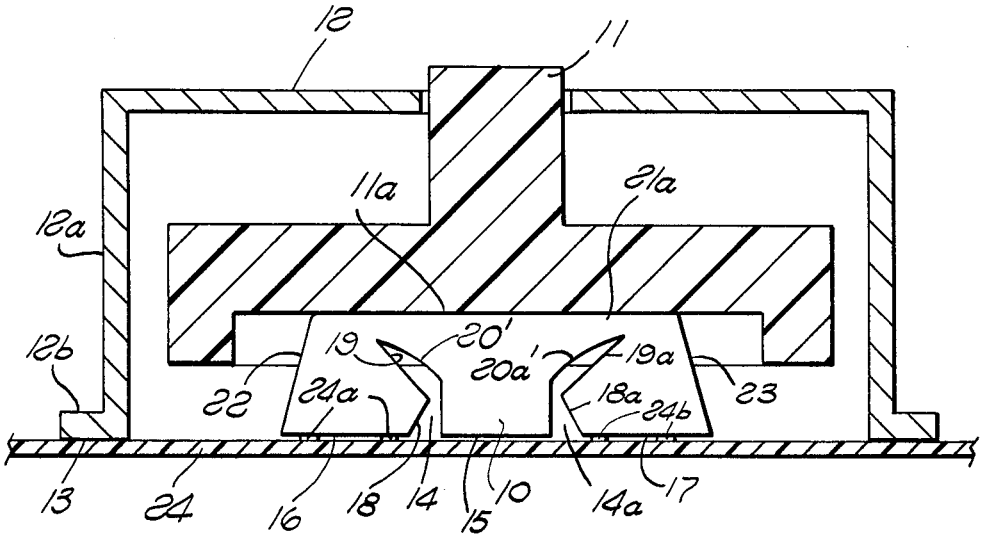
FIG. 2 corresponds to the switch assembly of FIG. 1, except that the conductive elastomer is shown fully compressed corresponding to switch closure.

Referring now also to FIG. 2, which depicts the switch closed situation rather than the switch open condition depicted in FIG. 1, the deflection of the bridging member 10 can be more clearly understood. In FIG. 2 it will be seen that the down compressive force exerted along the surface 11*a* of the push-button 11 downwardly deflects the "wings" of the bridging member 10 and substantially flattens out the surfaces 21 of FIG. 1 into a substantially planar surface 21*a* in planar contact with the surface 11*a*. This causes the contact surfaces of the bridging member 10, i.e., surfaces 16 and 17 to be brought into compressive contact against the printed circuit traces 24*a* and 24*b*. respectively. The surfaces 22 and 23 rotate around to a position illustrated on FIG. 2 as do the surfaces 18, 19 and 18*a* and 19*a*. The surfaces 20 and 21*a* of FIG. 1 tend to curve forming surfaces 20' and 20*a'*, respectively as illustrated in FIG. 2.

At this point some comments as to materials are appropriate. The circuit board 24 is of course of a dielectric material typical for printed circuit boards. The conductive elastomer 10 may be of either the known prior art fully conductive materials, such as one of the conductive rubbers commercially available, or may be of the type including the conductive particles therein such as silver flake, etc., as also known in the prior art. The former is basically conductive at rest as well as under compression whereas the latter becomes conductive when subjected to compression. The push-button itself while illustrated as nonconductive may actually be of a metal or conductive material in such specialized circumstances in which body contact is not of importance. The normal configuration, however, dictates that the push-button should be of nonconductive material, for example, one of the relatively high temperature thermoplastics commonly employed in similar applications.

Of course, the release of the compressive force applied to the push-button 11 to cause the assembly to assume the condition of FIG. 2, results in reversion to the condition of FIG. 1 due to the resilience of the conductive elastomer bridging member 10.

Figure 3:
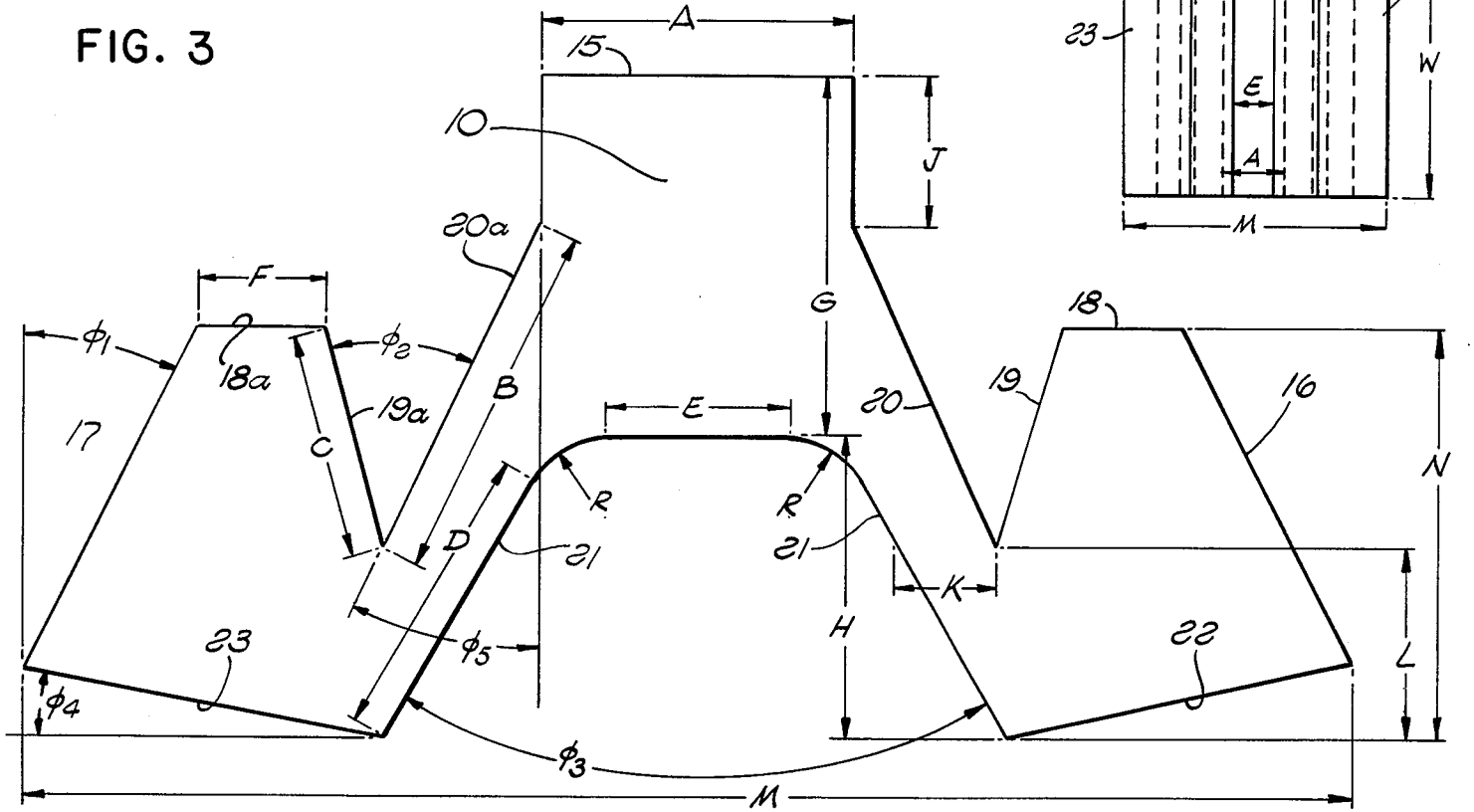
FIG. 3 is a side view of the elastomer member itself in magnified form.

Referring now to FIG. 3, a much magnified view of the conductive elastomer bridging member is presented. The member 10 as depicted in FIG. 3 is inverted as will be readily realized from the indentification of the surfaces, in particular, surface 15.

Table 1, following tabulates the actual dimensions, angles and radii depicted on FIG. 3 for a conductive elastomer bridging element employed in a particular embodiment of a miniature switch according to the invention. These values are largely empirically determined and are consistent with conductive rubber material.

TABLE I

| Dimension | Division (Inches) | Numerical Drawing Call-out |
|---|---|---|
| A | 0.093 | 15 |
| B | 0.106 | 20 & 20a |
| C | 0.068 | 18 & 19a |
| D | 0.088 | 21 |
| E | 0.056 | — |
| F | 0.039 | 18 & 18a |
| G | 0.109 | — |
| H | 0.900 | — |
| J | 0.043 | — |
| K | 0.030 | — |
| L | 0.056 | — |
| M | 0.400 | — |

TABLE I-continued

| Dimension | Division (Inches) | Numerical Drawing Call-out |
|---|---|---|
| N | 0.122 | — |
| $\phi_1$ | 62° | — |
| $\phi_2$ | 38° | — |
| $\phi_3$ | 60° | — |
| $\phi_4$ | 12° | — |
| $\phi_5$ | 25° | |
| W | 0.400 | |
| R | 0.025 | |

Figure 4:
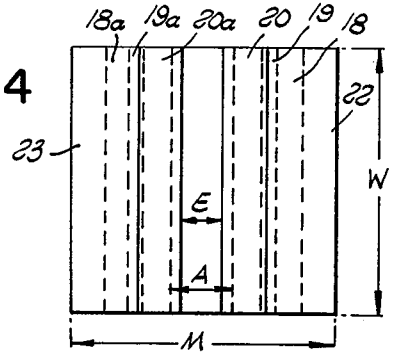
FIG. 4 is a top view of FIG. 3 as depicted.

FIG. 4 is a much reduced (as compared to FIG. 3) view of the lower surface of FIG. 3 as depicted. This is the surface which is in contact with push-button surface 11*a* in FIGS. 1 and 2. The dimension W of FIG. 4 is subject to design variation, and in a particular application was smaller than dimension M. In the embodiment illustrated in FIG. 4, the dimension W is equal to dimension M. This dimension W if relatively large lowers the over circuit resistance through the switch in its closed condition. Obviously, it is also possible to gang two or more bridging elements 10 having W dimensions substantially smaller than their M dimensions to produce the affect of a larger dimension W insofar as resistance is concerned. Such an expedient is of course only possible if the layout of the circuit conductors and space considerations permit.

Other modifications and variations of the embodiment disclosed and described would suggest themselves to those skilled in this art, once the concepts of the invention are understood. Accordingly, it is not intended that the drawings or this description should be considered as limiting the scope of the invention, it being intended that the drawings and this description be typical and illustrative only.

What is claimed is:

1. A push-button switch for use with printed-conductor electronic circuit boards, comprising:

two pairs of spatially separated but generally parallel printed conductors on said circuit board;

a resilient conductive elastomer member having a portion in contact with said circuit board between said two pairs of conductors, said member being shaped, when unstressed, to have a pair of cantilevered upwardly and outwardly, oppositely extending wing portions each positioned over a corresponding pair of said conductors in spaced relationship so as not to produce contact therewith;

and push button means mounted over and separate from said member and movable relative to said wing portions, said push button means applying a compressive force to said wing portions to deflect said wing portions downwardly into contact with said corresponding pairs of conductors.

2. An electric push-button switch particularly adapted for use with printed conductor, electronic circuit boards, comprising:

at least two separated, printed conductors in a surface plane on said circuit board, between which electrical continuity is to be selectively made and interrupted;

at least one bridging switch member of conductive elastomer material, said bridging member having a first shaped surface facing said circuit board surface plane comprising a base surface in contact with said circuit board and at least one cantilevered portion diverging away from said surface plane as a function of distance from said base surface to overhang at least two of said printed conductors in the absence of applied force to said bridging member;

means for selectively exerting a compression force against said bridge member to deflect said cantilevered portion into contact with at least said two conductors, said bridge member returning to said diverging condition of said cantilevered portion to break contact with said conductors due to resilience of said bridge member upon release of said compressive force; and said cantilevered portion being produced by at least one groove extending into the body of said bridge member from said first shaped surface and extending through the dimension of said body in the direction parallel to said printed conductors in the region of said bridge member.

3. Apparatus according to claim 2 in which the surface of said bridge member to which said compressive force is applied is defined as a second surface and is opposite said first surface thereof, said second surface having a cavity therein extending opposite said base surface and into said bridge member body toward said first bridge member surface, thereby to generate said cantilevered portion.

4. Apparatus according to claim 3 in which said groove is generally triangular ending at a point in the axial cross-section of said bridge member thereby to produce a neck portion between said groove and said cavity, said neck deflecting to facilitate said cantilevered portion deflection.

5. Apparatus according to claim 3 in which said means for exerting said compressive force is adapted to apply said compressive force over at least a substantial portion of the area of said second surface in a direction normal to said circuit board surface plane, said second surface tending to become planar as said cantilevered portion deflects in response to said compressive force.

6. An electric push-button switch particularly adapted for use with printed conductor, electronic circuit boards, comprising:

at least two separated, printed conductors in a surface plane on said circuit board, between which electrical continuity is to be selectively made and interrupted;

at least one bridging switch member of conductive elastomer material, said bridging member having a first shaped surface facing said circuit board surface plane comprising a base surface in contact with said circuit board and at least one cantilevered portion which, when unstressed, diverges upwardly and outwardly away from said surface plane to overhang in spaced relation said printed conductors;

and means mounted over and separate from said member and movable relative to said cantilevered portion for selectively exerting a compressive force against said cantilevered portion to deflect said cantilevered portion into contact with at least said two conductors, said cantilevered portion returning to said diverging condition to break contact with said conductors due to resilience of said bridge member upon release of said compressive force.

7. Apparatus according to claim 6 in which said cantilevered portion has a planar contact surface, when said cantilevered portion is unstressed, said planar contact surface extending upwardly and outwardly at such an angle relative to said circuit board surface plane so as to come into plane-to-plane contact with said circuit board surface plane against said conductors in response to said compressive force.

8. Apparatus according to claim 6 in which said bridge member has two of said cantilevered portions disposed symmetrically, one on each side of the body of said member over said base surface, and in which said printed conductors comprise at least one conductor on either side of said base surface, one of said cantilevered portions contacting each of said conductors in response to said compressive force, said force exerting means being movable relative to both said cantilevered portions.

* * * * *